US009695690B2

(12) United States Patent
Healy

(10) Patent No.: US 9,695,690 B2
(45) Date of Patent: Jul. 4, 2017

(54) SUPPORT FOR USE IN MINE

(71) Applicant: Burrell Mining Products, Inc., New Kensington, PA (US)

(72) Inventor: Ian Edward Healy, New South Wales (AU)

(73) Assignee: Burrell Mining Products, Inc, New Kensington, PA (US)

( * ) Notice: Subject to any disclaimer, the term of this patent is extended or adjusted under 35 U.S.C. 154(b) by 0 days.

(21) Appl. No.: 15/023,545

(22) PCT Filed: Sep. 29, 2014

(86) PCT No.: PCT/AU2014/050254
§ 371 (c)(1),
(2) Date: Mar. 21, 2016

(87) PCT Pub. No.: WO2015/048847
PCT Pub. Date: Apr. 9, 2015

(65) Prior Publication Data

US 2016/0208609 A1 Jul. 21, 2016

(30) Foreign Application Priority Data

Oct. 1, 2013 (AU) ..... 2013903781

(51) Int. Cl.
*E21D 15/44* (2006.01)
*E21D 15/14* (2006.01)

(52) U.S. Cl.
CPC ..... *E21D 15/44* (2013.01); *E21D 15/14* (2013.01)

(58) Field of Classification Search
CPC ..... E21D 15/44; E21D 15/18; E21D 15/486; E21D 15/00; E21D 15/14; E21D 15/445; E21D 15/45; E21D 15/16; E04G 2025/047; E04G 25/04
USPC .... 405/288, 290, 294, 302.1; 299/11, 12, 33
See application file for complete search history.

(56) References Cited

U.S. PATENT DOCUMENTS

| | | | |
|---|---|---|---|
| 5,273,378 | A | 12/1993 | Merz |
| 5,413,436 | A | 5/1995 | Merz |
| 5,921,718 | A | 7/1999 | Kolk |
| 6,394,707 | B1 | 5/2002 | Kennedy et al. |
| 9,140,026 | B2 | 9/2015 | Barnett |
| 2011/0262231 | A1 | 10/2011 | Hussey et al. |
| 2013/0149044 | A1 | 6/2013 | Barnett |
| 2014/0064859 | A1 | 3/2014 | Shook |

FOREIGN PATENT DOCUMENTS

| | | | |
|---|---|---|---|
| AU | 674489 | B3 | 12/1996 |
| AU | 683462 | B2 | 11/1997 |
| AU | 2010257264 | B1 | 6/2011 |

(Continued)

*Primary Examiner* — Benjamin Fiorello
*Assistant Examiner* — Carib Oquendo
(74) *Attorney, Agent, or Firm* — TraskBritt

(57) ABSTRACT

A support comprising an outer casing having a main axis, the outer casing comprising a first casing part and a second casing part, the first casing part being at least partially receivable within the second casing part to enable relative movement therebetween in the axial direction, the casing parts having a cavity therein at least one of which has a core that includes a compressible medium, the support further including a pressure responsive system configured so that under the influence of pressure it can cause the relative displacement or movement between the first and second casing parts.

19 Claims, 5 Drawing Sheets

(56) References Cited

FOREIGN PATENT DOCUMENTS

| | | | |
|---|---|---|---|
| DE | 202007004100 | U1 | 5/2007 |
| GB | 267860 | A | 3/1927 |
| GB | 716022 | A | 9/1954 |
| WO | 2012016272 | A1 | 2/2012 |
| WO | 2012056393 | A1 | 5/2012 |

SUPPORT FOR USE IN MINE

BACKGROUND

There is a constant danger in underground mining of the collapse of the mine tunnel. Many different arrangements have been proposed to inhibit the collapse of, in particular, the roof of a mine. Support installations for supporting the side walls or roof of an underground mine are often categorized as primary support installations and secondary support installations. Primary support installations are those utilized during the initial excavation of the mine and may, for example, involve the installation of rock bolts into the roof and walls of the mine to stabilize the strata. Secondary support installations are used to provide stability to the strata during and after the mining operations. Examples of secondary support installations include the use of roof bolts, cable bolts or support structures erected within the mine, such structures including beams and support columns, which provide additional structural support to the side walls and roof of the mine tunnel or shaft. For example, structures of this type may comprise timber or steel props or cribs, cast concrete columns and cribs or varied combinations of these materials plied together. Other structures in the art are constructed in-situ and are pumped, poured or cast with varying cementitious or other material to establish a secondary support installation. Such constructions, however, have certain drawbacks. For example, supports constructed of precast concrete and cementitious material require form work to be set, mixing and hatching systems established and managed and employment of a number of operators underground on site during construction. Furthermore, such installations can only function following the separation of strata and the convergence of the roof or when the heave of floor has begun before they begin to function in the designed manner.

Another type of support that has found considerable success is the type that comprises an outer shell, which is filled with a compressible or crushable material. The outer shell is also designed to collapse or yield at least to a certain extent as a result of, for example, subsidence of the main roof. The problems associated with supports of this type are that they are time consuming to install. Furthermore, it only provides a passive support arrangement in that it needs a subsidence to occur before it will commence to load the mine roof.

BRIEF SUMMARY

According to a first aspect there is provided a support comprising an outer casing having a main axis, the outer casing comprising a first casing part and a second casing part, the first casing part being at least partially receivable within the second casing part to enable relative movement therebetween in the axial direction, the casing parts each having a cavity therein at least one of which has a core which contains a compressible medium. The support or column further includes a pressure responsive system configured so that under the influence of pressure it can cause the relative displacement or movement between the first and second casing parts. In certain embodiments, the arrangement is such that in use a load can be applied to a wall of a structure, which is to be supported.

In certain embodiments, the first and second casing parts comprise first and second tubular members, which in one form comprise tubular or cylindrical bodies that may be circular in cross-section or any other suitable cross-section such as square, the first cylindrical body being at least partially receivable within the second cylindrical body in slidable or telescopic fashion. In certain embodiments, at least one of the first or second casing parts is configured so as to be at least partially collapsible or adapted to yield under an axial load. In one embodiment it is the first casing part and in another embodiment it is the second casing part. In certain embodiments, both the first and second casing parts are configured so as to be at least partially collapsible or adapted to yield under an axial load. In certain embodiments, the first and second casing parts are formed from metal such as, for example, steel such as rolled mild steel and hot rolled mild steel. In other embodiments, the casing parts may be formed from composite materials.

In certain embodiments, each casing part has a cavity associated therewith and a core section disposed therein. In certain embodiments, the pressure responsive system comprises a zone, which can provide for a pressure chamber disposed between the core sections.

In certain embodiments, the pressure responsive system comprises two barrier walls within one or both cavities that are adapted to be axially displaced relative to one another under the influence of pressure within the pressure chamber, which is disposed therebetween. In certain embodiments, the barrier walls are in the form of disc-like elements mounted in a plane which is lateral and preferably at right angles with respect to the axial direction and having a cross-sectional dimension similar to the cross-section dimension of the cavities.

In certain embodiments, the pressure responsive system further includes a pressure medium delivery assembly for delivering a medium under pressure to the pressure chamber. In certain embodiments, the assembly comprises a feed conduit pipe or line having an inlet operatively connectable to a pressurized medium source and a manifold between the feed conduit or pipe for delivery of the pressurized medium to the pressure chamber from the feed conduit or pipe. The pressurized medium may comprise a non-compressible substance, such as a cement grout, which may be an expanding rapid set grout or may be water, emulsion, fluid, oil or other non-compressible hydraulic medium. In certain embodiments, at least part of the pressure responsive system is at least partially encased within the core section in the second casing part. In certain embodiments, the feed conduit pipe or line and the manifold are encased within the case in the second casing part. In certain embodiments, the pressurizing medium, which comprises a non-compressible or hydraulic substance is arranged such that the support can adopt an activated mode in which the pressure chamber contains the pressurized non-compressible substance, the arrangement being such that the pressure chamber in the activated mode provides for a non-compressible region between the two core sections each of which contain a compressible medium.

In certain embodiments, each barrier wall has a transfer aperture or passage therein. In certain embodiments, a venting port is provided which is in communication with the casing in the second casing part.

In a second aspect, there is provided a method of assembling a support, the support comprising an outer casing having a main axis, the outer casing comprising a first casing part and a second casing part, the first casing part being at least partially receivable within the second casing part to enable relative movement therebetween in the axial direction, each casing part having a cavity therein for receiving a core section, which comprises a compressible core forming medium. The support further includes a pressure responsive system configured so that under the influence of pressure it can cause the relative movement between the first and second casing parts, the pressure responsive system including a zone which provides for a pressure chamber disposed between the cavities for the core sections, the support further including at least one transfer passage between the cavities, the method including the step of feeding a compressible core forming medium to one of the cavities whereby at least a portion of the core forming medium passes through the or each passage into the other cavity.

In certain embodiments, the core forming medium is fed into the cavity in the first casing part and the at least a portion thereof passes through the or each passage to the cavity in the second casing part.

In certain embodiments, the core forming medium is fed into the cavity in the first part until each cavity is filled.

In certain embodiments, the pressure responsive system comprises two barrier walls within at least one of the cavities between the or each transfer passage being in the barrier walls.

In certain embodiments, the barrier walls are in abutting relation when the core forming medium is being fed to one of the cavities.

In a third aspect, there is provided a method of installing a support in a structure that comprises two spaced apart opposed walls, the support or column being as described above, the method comprising the steps of locating the support, when in a retracted state and non-active mode between the opposed walls, causing the pressure response system to generate a pressure, thereby causing axial displacement of the first and second casing parts so that the support adopts an activated mode in which a force is applied to at least one of the walls of the structure.

As is apparent from the foregoing, in certain embodiments of the support, when in use, the arrangement can provide for a preloading of the structure to be supported. In the particular application of providing support for a mine roof this can be particularly advantageous. The roof strata in most underground mines is made up of laminations of compressed stone, rock, clay, mud and, in some cases, coal material. Materials that are laminated together provide a very strong support structure. A first principle in underground mining is to ensure that those laminates remain strongly bonded together and do not separate under load. The support provides a high degree of clamping pressure to maintain strata laminations and strengthen the roof.

Furthermore, in certain embodiments, when the support is in an activated mode, the support structure of one embodiment is separated into three distinct zones; the first zone being the core of compressible medium in the first casing part; the second zone being the core of compressible material in the second casing part; and the third zone being the pressure chamber when filled with pressurized non-compressible or hydraulic medium, which is disposed between the first and second zones. Yield or loading of the structure is managed in both the first and second zones and rigidity and stiffness is managed in the third zone of the support.

Furthermore, as described in certain embodiments, the pressure responsive system is disposed within the cavities and comprises two barrier walls, which are axially displaceable relative to one another with a pressure chamber therebetween which can convert a small force into a much larger force, capable of doing work. By arranging the system within the support, the work done is, extends the length of the support and applying a clamping force to the roof strata. The configuration ensures that all available area within the support is utilized to maximise the force that can be generated.

BRIEF DESCRIPTION OF THE DRAWINGS

Notwithstanding any other forms that may fall within the scope of the methods and apparatus as set forth in the Summary, specific embodiments will now be described, by way of example, and with reference to the accompanying drawings in which.

DETAILED DESCRIPTION

Figure 1:
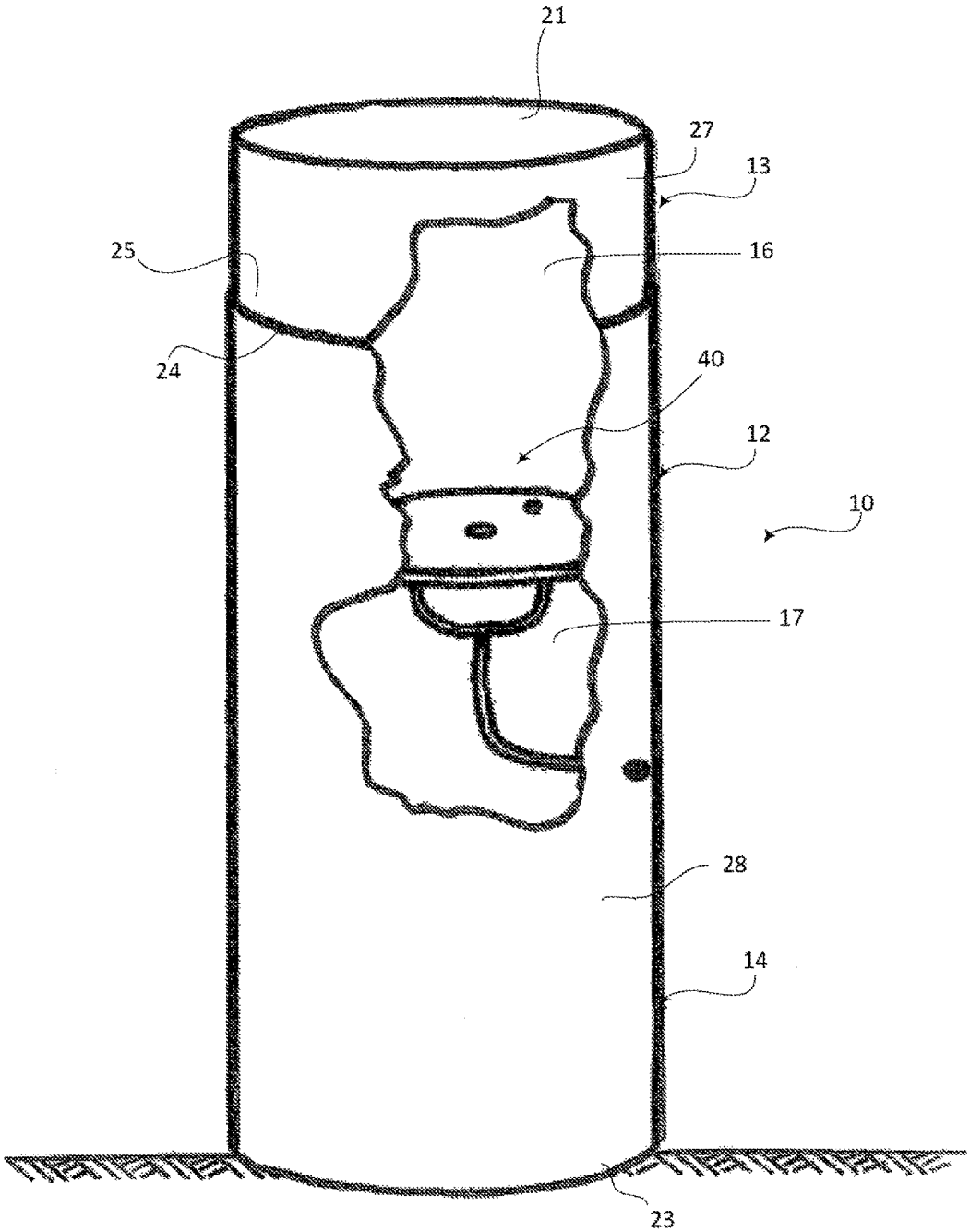
FIG. 1 is a schematic partially cut away illustration of a support or column according to one embodiment.

Referring to the drawings, there is illustrated a support or column 10 having a main axis 11 (FIGS. 2, 3 and 5) for use in a mine tunnel, the support or column 10 comprising an outer casing or shell 12, which includes a first casing part 13 and a second casing part 14. The first casing part 13 is at least partially receivable within the second casing part 14 so as to be capable of slidable movement or axial displacement in the direction of the column axis 11 from a retracted state or position to an extended state or position. In the retracted state or position the overall length of the support or column is less than when in the extended state or position. Each casing part 13 and 14 has a cavity 16 and 17 therein for receiving a core which in the embodiment of FIGS. 1-3 comprises compressible or crushable core sections 18 and 19. The core sections 18 and 19 may be formed in any suitable manner. In one example embodiment, the core comprises an aerated cementitious material such as a low density air entrained cement. It will be appreciated, however, that the core could be formed in other ways such as by using materials such as foams or crushable particulate matter.

Figure 2:
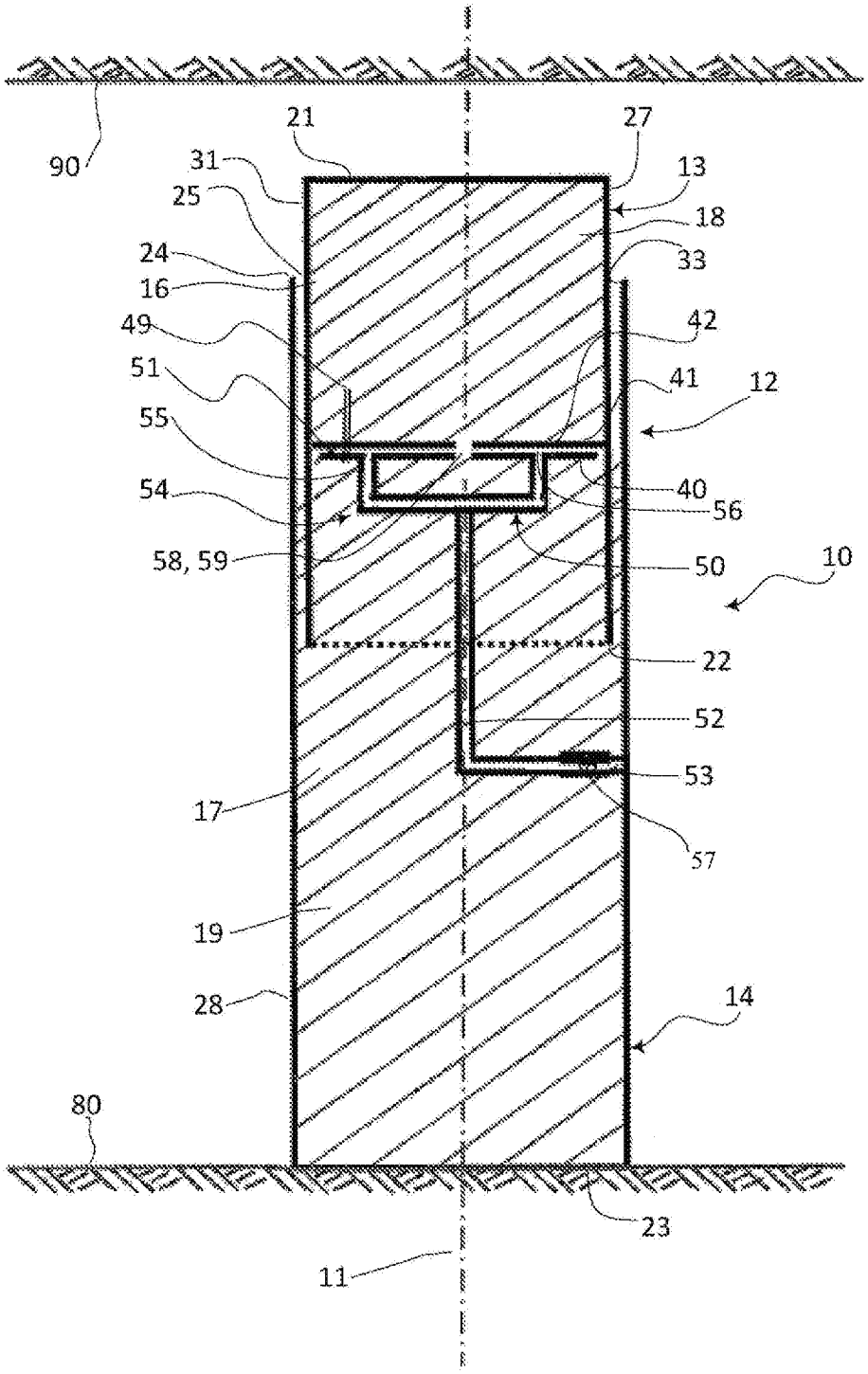
FIG. 2 is a schematic sectional side elevation of the support or column shown in FIG. 1 in one position.

When in use to provide support between the floor and roof of a mine tunnel the support or column 10 is disposed with its axis 11 in a generally upright position and extending between the floor 80 of the mine and the roof 90 of the mine (FIG. 2). In one arrangement, the first casing part 13 has an outer end 21, which, in use, is positioned adjacent the roof of the mine and an inner end 22 positioned within the cavity 17 of the second casing part 14. The second casing part 14 has an outer end 23, which, in use, is positioned or on adjacent the floor of the mine and an inner end 24 having an opening 25 through which the first casing part 13 can extend into the exterior of the second casing part 14. End caps or closures (not shown) may be located on the outer ends 21 and 23 of casing parts 13 and 14. In certain applications, end caps may not be used with certain casing parts being open at one or both ends 21 and 23. In another arrangement, the support or column 10 may be inverted so that the first casing part 13 is positioned adjacent the floor 80 and the second casing part 14 adjacent the roof 90.

The first and second casing parts 13, 14 may be generally tubular in form and, in the embodiment illustrated, they comprise cylindrical bodies 27 and 28, one being slidably receivable with the other in telescopic fashion. The cylindrical body 27 forming the first casing part 13 has an outer surface 31 which forms a close or interference fit with inner surface 33 of the cylindrical body 28 forming the second casing part 14. A non-stick material such as silica or mold oil or a release agent may be applied to the surfaces in contact with one another. At least one or both of the casing parts are configured so as to be at least partially collapsible or adapted to yield under axial load.

Figure 3:
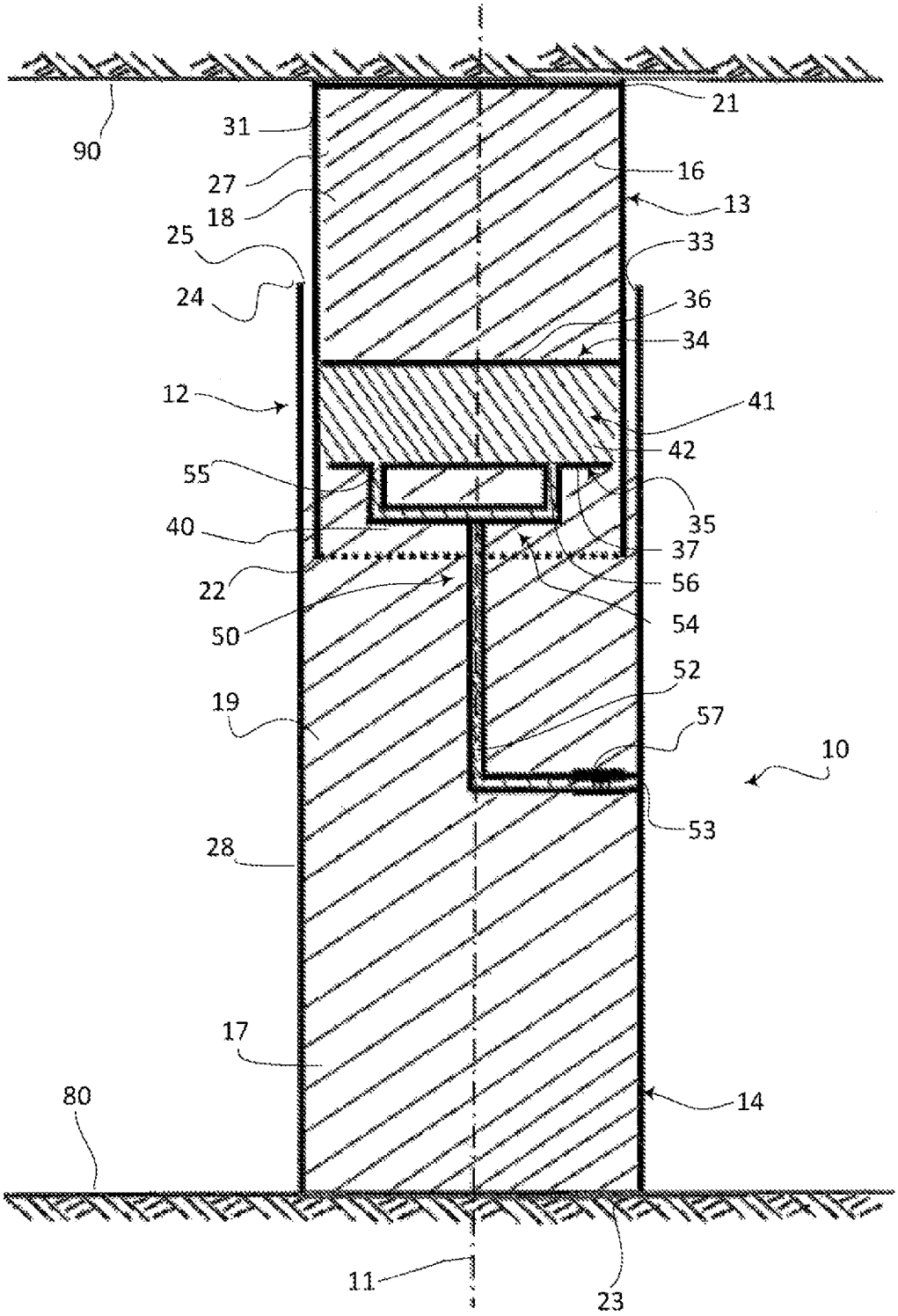
FIG. 3 is a similar view to that shown in FIG. 2 in another position.
Figure 4:
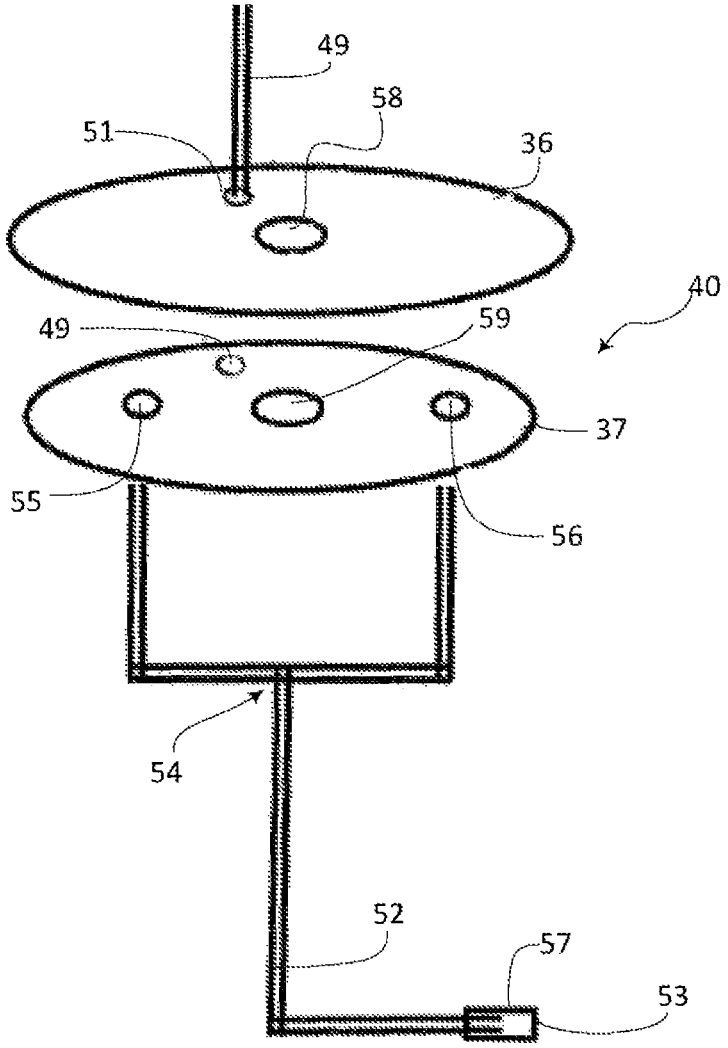
FIG. 4 is a schematic exploded view of a component of the support or column.

The support or column 10 further includes a pressure responsive system 40 which is configured under influence of pressure to cause axial movement of the first casing part 13 relative to the second casing part 14. As illustrated more clearly in FIG. 4, the pressure responsive system 40 includes a zone 41, which can provide for a pressure chamber 42 disposed between the core sections 18 and 19 (see also FIG. 3) arranged so that pressure can be applied in the zone 41 to cause the first casing part 13 to be displaced relative to the second casing part 14. As shown in FIG. 3, the system 40 comprises two barrier walls 34 and 35 in the form of disc-shaped plates 36 and 37, one plate 36 being secured to the inner surface of first casing part 13. The plates 36 and 37 are adapted to be axially displaced relative to one another. The space therebetween forms the pressure chamber 42. The plates 36 and 37 are disposed in a plane that is generally at a right angle to the main axis 11 and have a cross-sectional dimension, which is about the same as the cross-sectional dimension of the cavities 16 and 17.

A pressure medium delivery assembly 50 is arranged to deliver a pressurized medium to the pressure chamber 42. The pressure medium may be in the form of a non-compressible or hydraulic substance or fluid such as, for example, water, although it will be understood other fluids or materials such as non-compressible grout may also be suitable. Prior to the delivery of pressurized fluid or material to the pressure chamber 42, the support or column 10 is in a non-active mode and in the retracted state or position. The delivery of the pressurized fluid or material to the pressure chamber 42 causes relative axial displacement of the two casing parts 13 and 14 such that the support or column 10 adopts active mode in which the column is in an extended state in which a force is exerted in the axial direction. In the active mode, the ends of support or column 10 operatively bear against opposed walls of the tunnel or the like; that is the ends are in direct or indirect contact with the walls so that the force generated by pressure responsive system 40 can be exerted on the walls.

The pressure medium delivery assembly 50 comprises pressure lines including a feed pipe or conduit 52 operatively connected to an inlet 53, which, in turn, can be operatively connected to a fluid source (not shown), which can deliver pressurized fluid to the feed pipe or conduit 52. The feed pipe or conduit 52 is in fluid communication with a manifold 54 having outlets 55 and 56 operatively connected to plate 37 for delivering pressurized fluid to the pressure chamber 42. The pressure lines are substantially encased within the core section 19. Because the pressure lines including the feed pipe 52 and manifold 54 are encased within the core section 19 relatively low rated pipes or tubes can be utilized. In use, the plate 37 rests on or is at least partially encased in the core section 19 and thus inhibited from any substantial axial movement as a result of pressure width in the pressure chamber 42. Transfer apertures 58 and 59 are provided in the plates 36 and 37 for reasons which will hereinafter become apparent. A one-way valve 57 is provided in the feed pipe or conduit 52, which inhibits return of pressurized fluid to the inlet port 53. The pressure lines are encased in the core section 19. A venting port 51 and associated snorkel 49 (FIG. 4) is provided in the plates 36 and 37, the snorkel 49 extending into the cavity 16.

One method of assembling the support 10 is as follows. First the two casing parts 13 and 14 are slid together so that the plates 36 and 37 are abutting or in close proximity to one another. The core forming material is then fed into the cavity 16 through the outer end 21 and thereafter passes through the transfer apertures or passages 58 and 59 into the other cavity 17. The venting port 51 and associated snorkel 49 enables air to escape from cavity 17 during the filling operation. When the cavities 16 and 17 are full, an end cap can, if desired, may be placed on the end 21. In certain situations an end cap may not be used. For example, if it was considered desirable to expose the core forming material to the strata so that it will conform to any irregularities in the strata under axial movement resulting from the pressure responsive system; that is the core will contact the strata over the entire surface area. The core forming material may be an aerated cementitious composition that is flowable when being fed into the cavities and which thereafter hardens.

One method of installing a support is as follows. With the support or column 10 in the retracted state or position or non-activated mode it is positioned in an upright configuration, the lower end resting on the mine floor 80 and the upper end being spaced from the mine roof 90. A pressurized medium is then delivered to feed pipe 52 via inlet port 53 whereupon it is fed into the pressure chamber 42 between the barrier walls. The pressure causes an expansion in the region of the pressure chamber 42 causing upward movement of the first casing part 13 until its end abuts against the mine roof 90. The pressure source can then be removed and the position maintained because of the one-way valve 57. The pressure within the pressure chamber 42 can be regulated at a preload pressure. If an axial load is applied to the support as a result of subsidence of the mine roof 90, the support 10 can at least partially collapse. For example, in an initial stage the first casing part 13 is pushed into the second casing part 14. The core sections then collapse simultaneously thereafter if the subsidence load is sufficiently large.

As will be apparent from the foregoing description, the support as described provides positive support of a mine roof or wall which is formed from crushable or yieldable material that permits and controls yielding during a mine convergence event. For example, while supporting the mine roof or floor, there is provision of the support to resistant to columnar shear failure by allowing yield throughout the majority of the column. There is also provision in such a support that is quick and easily installed and the provision of the support that is adaptable to varying passageway or tunnel heights. Furthermore, it provides support for a support that does not require chocking timbers to fix it in place.

The support can be constructed at a manufacturing plant environment and not necessarily underground, so that costs and quality are much less and better controlled.

When in the activated mode, the support or column of the first embodiment comprises two separate regions or areas, which are compressible under load separated by a non-compressible region. The compressible regions comprise the cavities 16 and 17 containing respective crushable core sections 18 and 19. The non-compressible region comprises the zone 41 when it is filled or contains an appropriate amount of non-compressible or hydraulic medium. This section of the support or column 10 is strengthened or reinforced so that the support or column, when under axial load is resistant to bending or a bending moment. The support further includes a region or regions that is crushable under axial load caused, for example, by subsidence of the roof or heave of the floor. The yield or collapse of the column under load is controlled by compressible regions and hooping containment.

Figure 5:
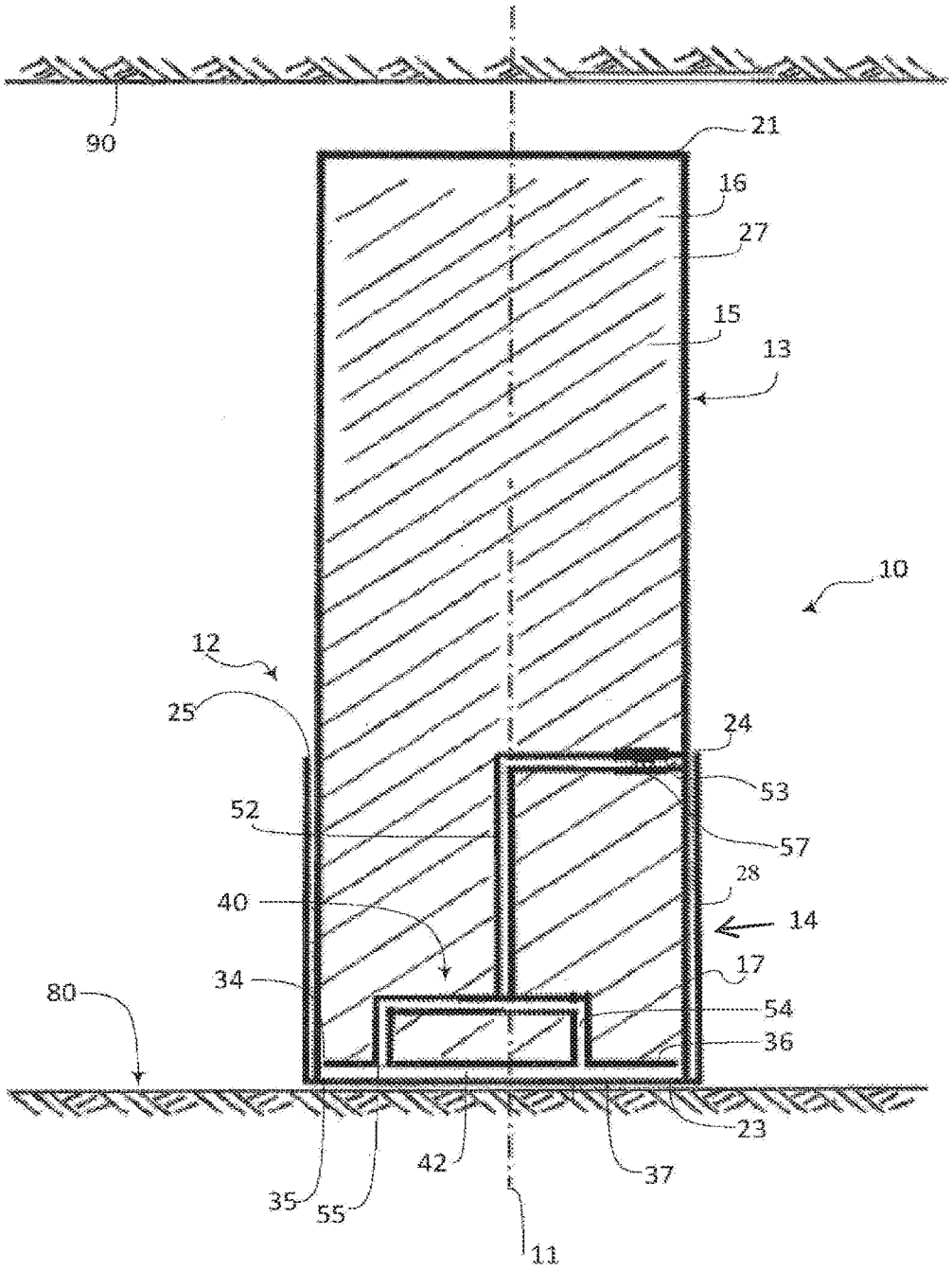
FIG. 5 is a schematic sectional side elevation of a support or column according to another embodiment.

The first embodiment provides significant advantages because of the arrangement of the core sections and pressure responsive zone. It is conceivable that the pressure responsive zone could be disposed at one end. This is illustrated in FIG. 5. In this embodiment, there is only one core 15 in one of the cavities 16. One of the barrier walls of the pressure responsive system 40 is provided by an end cap. Like reference numerals have been used to identify like parts described with reference to the first embodiment. The arrangement operates in the same manner as that described with reference to the first embodiment except that the whole core 15 is displaced.

The support can be installed by using other equipment designed for the transportation and installation of roof support underground, to the place where it is to be installed. The support is stood in an upright position where the roof is to be supported. Not limited to, but by way of example, mine grout is mixed separately and a grout pump and its delivery hose is fitted to the mine roof support invention. Not limited to any type of material but being non-compressible, grout is pumped into the roof support causing the pressure responsive system to extend the telescoping containment members apart, until it contacts the roof. Further pressure is applied, measured via an instrument or gauge to ensure the required ton force is achieved for control of strata. A non-return valve in the pressure responsive system traps and locks grout pressure, some grout materials used will be quick hardening, others may not. The roof support is in place by positively preloading the roof and minimizing the risk of strata bed separation, while still managing convergence throughout the majority of the containment structure.

In a mine, the support of roof and floor function is a function of the mining process. These functions contain risk to the safety and health of mine employees and mining equipment. This disclosure sets out to mitigate some of those risks. The support is manufactured on the surface where risk and cost can be better managed. It is taken underground to the place of installation and with mechanization installed to support the roof and floor of the mine. The support is arranged so that it can "actively" load and support the roof and floor. Other secondary supporting art is passive and loads only as a function of convergence. The support is designed to protect mine roof and floor and combat the effect of forward abutment loading that exist ahead of mining buy preloading that strata before the abutment load.

While the support has been described with reference to the particular application of mine tunnels and shaft, it may also find application in other tunneling arrangements and also in the construction industry.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "front" and "rear," "inner," and "outer," "above," "below," "upper" and "lower" and the like are used as words of convenience to provide reference points and are not to be construed as limiting terms.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavor to which this specification relates.

Throughout this specification and the claims which follow, unless the context requires otherwise, the word "comprise," and variations such as "comprises" or "comprising," will be understood to imply the inclusion of a stated integer or step or group of integers or steps but not the exclusion of any other integer or step or group of integers or steps.

Furthermore, the invention(s) has described in connection with what are presently considered to be the most practical and preferred embodiments, it is to be understood that the invention is not to be limited to the disclosed embodiment, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

TABLE OF PARTS

10 Support
12 Outer casing
13 First casing part
14 Second casing part
15 Core
11 Main axis
16 Cavity
17 Cavity
18 Core section
19 Core section
27 Cylindrical body
28 Cylindrical body
21 Outer end
22 Inner end
23 Outer end
24 Inner end
25 Opening
31 Outer surface
33 Inner surface
40 Pressure responsive system
41 Zone
42 Pressure chamber
34 Barrier wall
35 Barrier wall
36 Disc plate
37 Disc plate
49 Snorkel
50 Pressure medium delivery assembly
51 Venting port
52 Feed pipe or conduit
53 Inlet port
54 Manifold
55 Outlet
56 Outlet
58 Transfer aperture
59 Transfer aperture
57 Valve

The invention claimed is:

1. A support comprising an outer casing having a main axis, the outer casing comprising a first casing part, and a second casing part, the first casing part being at least partially receivable within the second casing part to enable relative movement therebetween in an axial direction, each of the casing parts having a cavity therein and a core therein that includes a compressible medium, the support further including a pressure responsive system configured so that under the influence of pressure it can cause the relative displacement or movement between the first and second casing parts, the pressure responsive system comprising a zone, which can provide for a pressure chamber disposed between the cores.

2. The support according to claim 1, wherein the first and second casing parts comprise tubular members one being at least partially receivable within the other for relative axial movement.

3. The support according to claim 1, wherein the first and second casing parts comprise first and second cylindrical bodies, the first cylindrical body being at least partially receivable within the second cylindrical body in sliding or telescopic fashion, the cavities being provided by an interior of each cylindrical body.

4. The support according to claim 1, wherein the pressure responsive system comprises two barrier walls within the cavities that are adapted to be axially displaced relative to one another with the pressure chamber being disposed therebetween.

5. The support according to claim 4, further including transfer apertures or passages in the barrier walls.

6. The support according to claim 1, wherein pressure responsive system further includes a pressure medium delivery assembly for delivering a pressurizing medium under pressure to the pressure chamber.

7. The support according to claim 6, wherein the pressurizing medium comprises a non-compressible substance.

8. The support according to claim 7, wherein the support can adopt an activated mode in which the pressure chamber contains the pressurized non-compressible substance, the pressure chamber in the activated mode providing for a non-compressible region between the two cores, each of which contain a compressible medium.

9. The support according to claim 6, wherein the pressure medium delivery assembly includes a feed pipe or conduit and a manifold.

10. The support according to claim 1, wherein the first or second casing parts are configured so as to be at least partially collapsible or adapted to yield under axial load.

11. The support according to claim 1, wherein at least part of the pressure responsive system is at least partially encased within the core in the second casing part.

12. The support according to claim 11, further including a venting port in communication with the cavity in the second casing part.

13. A method of assembling a support, the support comprises an outer casing having a main axis, wherein the outer casing comprises a first casing part and a second casing part, the first casing part being at least partially receivable within the second casing part to enable relative movement therebetween in the axial direction, each casing part having a cavity therein for receiving a core that comprises a compressible core forming medium, the support further including a pressure responsive system configured so that under the influence of pressure it can cause the relative movement between the first and second casing parts, the pressure responsive system including a zone that provides for a pressure chamber disposed between the cavities for the cores, the support further including at least one transfer passage between the cavities, the method including the step of feeding a compressible core forming medium to one of the cavities, whereby at least a portion of the core forming medium passes through the or each passage into the other cavity.

14. The method of claim 13, wherein the core forming medium is fed into the cavity in the first casing part and the at least a portion thereof passes through the or each passage to the cavity in the second casing part.

15. The method according to claim 14, wherein the core forming medium is fed into the cavity in the first casing part until each cavity is filled.

16. The method according to claim 14, wherein the pressure responsive system comprises two barrier walls within the cavities between the or each transfer passage being in the barrier walls.

17. The method according to claim 16, wherein the barrier walls are in abutting relation when the core forming medium is being fed to one of the cavities.

18. The method according to claim 13, wherein a venting port is provided which is configured to facilitate the escape of air from the cavity in the second casing part when the case forming medium enables the cavity in the second casing part.

19. A method of installing a support in a structure that comprises two spaced apart opposed walls, the support being in accordance with claim 1, the method comprising the steps of locating the support, when in a retracted state and non-active mode between the opposed walls, causing the pressure responsive system to generate a pressure, thereby causing axial displacement of the first and second casing parts so that the support adopts an active mode in which a force is applied to at least one of the walls of the structure.

* * * * *